US010138885B2

(12) United States Patent
Ejim et al.

(10) Patent No.: US 10,138,885 B2
(45) Date of Patent: Nov. 27, 2018

(54) EQUAL-WALLED GEROTOR PUMP FOR WELLBORE APPLICATIONS

(71) Applicant: Saudi Arabian Oil Company, Dhahran (SA)

(72) Inventors: Chidirim Enoch Ejim, Khobar (SA); Rafael Adolfo Lastra Melo, Dhahran (SA); Jinjiang Xiao, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 171 days.

(21) Appl. No.: 15/144,491

(22) Filed: May 2, 2016

(65) Prior Publication Data

US 2016/0273535 A1 Sep. 22, 2016

Related U.S. Application Data

(63) Continuation of application No. 15/070,477, filed on Mar. 15, 2016.

(Continued)

(51) Int. Cl.
*F01C 1/063* (2006.01)
*F03C 2/00* (2006.01)

(Continued)

(52) U.S. Cl.
CPC ..... *F04C 13/008* (2013.01); *E21B 43/121* (2013.01); *F04C 2/084* (2013.01);

(Continued)

(58) Field of Classification Search
CPC ..... F04C 2/084; F04C 2/102; F04C 11/003; F04C 13/008; F04C 15/0096; F04C 14/24;

(Continued)

(56) References Cited

U.S. PATENT DOCUMENTS 3,007,418 A 4/1957 Brundage
2,866,417 A * 12/1958 Nubling ..... F04C 2/102 418/171

(Continued)

FOREIGN PATENT DOCUMENTS

DE 3444859 A1 * 6/1985 ..... F04C 15/068
DE 3520884 1/1986

(Continued)

OTHER PUBLICATIONS

E M Alhasan et al.: "Extending mature field production life using a multiphase twin screw pump," BHR Group 2011 Multiphase.

(Continued)

*Primary Examiner* — Theresa Trieu
(74) *Attorney, Agent, or Firm* — Fish & Richardson P.C.

(57) ABSTRACT

A gerotor pump includes an inner rotor comprising multiple teeth, the inner rotor configured to rotate about a first longitudinal gerotor pump axis. The gerotor pump also includes a hollow outer rotor including an outer surface and an inner surface having substantially identical contours, the inner surface configured to engage with the multiple teeth and to rotate about a second longitudinal gerotor pump axis. The pump includes a pump housing within which the inner rotor and the outer rotor are disposed, wherein the outer surface of the outer rotor defines gaps between the pump housing and the outer rotor.

21 Claims, 8 Drawing Sheets

Related U.S. Application Data

(60) Provisional application No. 62/133,696, filed on Mar. 16, 2015.

(51) Int. Cl.

| | |
|---|---|
| ***F03C 4/00*** | (2006.01) |
| ***F04C 2/00*** | (2006.01) |
| ***F04C 13/00*** | (2006.01) |
| ***F04C 2/10*** | (2006.01) |
| ***F04C 11/00*** | (2006.01) |
| ***E21B 43/12*** | (2006.01) |
| ***F04C 2/08*** | (2006.01) |
| *F04C 14/24* | (2006.01) |
| *F04C 15/00* | (2006.01) |

(52) U.S. Cl.
CPC ..... *F04C 2/102* (2013.01); *F04C 11/003* (2013.01); *F04C 15/0096* (2013.01); *F04C 14/24* (2013.01); *F04C 15/0092* (2013.01); *F04C 2240/54* (2013.01); *F04C 2250/20* (2013.01); *F05C 2201/021* (2013.01); *F05C 2201/0448* (2013.01); *F05C 2225/02* (2013.01)

(58) Field of Classification Search
CPC ..... F04C 15/0092; F04C 2240/20; F04C 2240/54; F04C 2250/20; F05C 2201/021; F05C 2201/0448; F05C 2225/02
USPC ..... 418/61.2, 61.3, 166, 171, 201.1, 83, 418/178–179, 270
See application file for complete search history.

(56) References Cited

U.S. PATENT DOCUMENTS

| | | | | |
|---|---|---|---|---|
| 3,034,484 | A | 5/1962 | Stefancin | |
| 3,129,875 | A | 4/1964 | Cirillo | |
| 3,139,835 | A * | 7/1964 | Wilkinson | F04C 2/102 418/171 |
| 3,272,130 | A | 9/1966 | Mosbacher | |
| 3,516,765 | A * | 6/1970 | Boyadjieff | F04C 2/102 418/61.1 |
| 3,680,989 | A | 8/1972 | Brundage | |
| 4,025,244 | A | 5/1977 | Sato | |
| 4,497,185 | A | 2/1985 | Shaw | |
| 4,658,583 | A | 4/1987 | Shropshire | |
| 4,986,739 | A | 1/1991 | Child | |
| 5,195,882 | A | 3/1993 | Freeman | |
| 5,653,585 | A | 8/1997 | Fresco et al. | |
| 6,413,065 | B1 | 7/2002 | Dass | |
| 6,454,010 | B1 | 9/2002 | Thomas et al. | |
| 6,530,211 | B2 | 3/2003 | Holtzapple et al. | |
| 6,544,013 | B2 | 4/2003 | Kato et al. | |
| 6,679,692 | B1 | 1/2004 | Feuling et al. | |
| 6,733,249 | B2 | 5/2004 | Maier et al. | |
| 7,093,665 | B2 | 8/2006 | Dass | |
| 7,226,279 | B2 | 6/2007 | Andoskin et al. | |
| 7,275,592 | B2 | 10/2007 | Davis | |
| 7,377,312 | B2 | 5/2008 | Davis | |
| 7,670,122 | B2 | 3/2010 | Phillips et al. | |
| 8,579,617 | B2 | 11/2013 | Ono et al. | |
| 8,821,138 | B2 | 9/2014 | Holtzapple et al. | |
| 8,960,309 | B2 | 2/2015 | Davis | |
| 2009/0016899 | A1 | 1/2009 | Davis | |
| 2009/0110579 | A1 | 4/2009 | Amburgey | |
| 2015/0071795 | A1 | 3/2015 | Vazquez et al. | |

FOREIGN PATENT DOCUMENTS

| | | | | |
|---|---|---|---|---|
| DE | 102012215023 | | 1/2014 | |
| EP | 0579981 | A1 * | 1/1994 | F04C 2/084 |
| EP | 1101024 | | 5/2001 | |
| EP | 1270900 | | 1/2003 | |
| EP | 1369588 | | 12/2003 | |
| WO | 2005066502 | | 7/2005 | |

OTHER PUBLICATIONS

Mirza, "The Next Generation of Progressive Cavity Multiphase Pumps use a Novel Design Concept for Superior Performance and Wet Gas Compression", BHR Group, 2007.
International Search Report. And Written Opinion of the International Searching Authority issued in International Application No. PCT/US2016/022424 dated May 27, 2016; 12 pages.
Britta Schöneberg: "Wet Gas Compression with Twin Screw Pumps," Calgary Pump Symposium 2005, 50 pages.
Hua et al., "Comparison of Multiphase Pumping Techniques for Subsea and Downhole Applications", Society of Petroleum Engineers, Oil and Gas Facilities, Feb. 2012, 11 pages.
Mirza, "Three Generations of Multiphase Progressive Cavity Pumping", Upstream Pumping Solutions, Winter 2012, 6 pages.
Parker, "About Gerotors", Published in 2008, 2 pages.
Gulf Cooperation Council issued in GCC Application No. GC 2016-30988 dated May 23, 2018, 4 pages.

* cited by examiner

EQUAL-WALLED GEROTOR PUMP FOR WELLBORE APPLICATIONS

CROSS-REFERENCE TO RELATED APPLICATIONS

This application is a continuation of and claims the benefit of priority to U.S. patent application Ser. No. 15/070,477, filed on Mar. 15, 2016, which claims the benefit of priority to U.S. Provisional Application Ser. No. 62/133,696, filed on Mar. 16, 2015, the entire contents of which are hereby incorporated by reference in their entirety.

TECHNICAL FIELD

This disclosure relates to pumping fluids, for example, fluids flowing through wellbores.

BACKGROUND

In many wellbore applications, pumps are used to transport fluids such as hydrocarbons, mud, coolant, water, or other fluids. For example, a pump can provide artificial lift to transport a fluid from a subterranean region to the surface. In some cases, positive displacement pumps are used to provide the artificial lift. For example, positive displacement pump types such as a Progressive Cavity Pump (PCP) can be used to transport fluid.

SUMMARY

This disclosure describes pumping fluids using a gerotor pump. For example, the gerotor pump can be used to pump fluids in a wellbore environment.

In some aspects, a gerotor pump includes an inner rotor including multiple teeth, the inner rotor configured to rotate about a first longitudinal gerotor pump axis, and a hollow outer rotor including an outer surface and an inner surface having substantially identical contours, the inner surface configured to engage with the multiple teeth and to rotate about a second longitudinal gerotor pump axis.

This, and other aspects, can include one or more of the following features. The outer rotor can include a wall between the outer surface and the inner surface, wherein a thickness of the wall along a circumference of the outer rotor is substantially equal. The pump can include a pump housing within which the inner rotor and the outer rotor are disposed, wherein the outer surface of the outer rotor defines gaps between the pump housing and the outer rotor. The pump housing can be a hollow pump housing. The pump housing can include an inlet end into which fluid is configured to flow and an outlet end out of which the fluid is configured to flow. The gaps between the pump housing and the outer rotor can be configured to allow the fluid to flow through. The fluid can be a wellbore fluid. The inner surface can define multiple teeth, wherein a number of teeth defined by the inner surface is greater than a number of teeth included in the inner rotor. The inner rotor can define four teeth and the inner surface can define five teeth. The inner surface and the outer surface can have five-point star shapes. The housing can be substantially circular. The inner rotor can have a helical shape. The inner rotor and the outer rotor can be made of metal. The pump can include an elastomer layer disposed on an outer surface of the inner rotor, the elastomer layer contacting the inner surface of the outer rotor when the multiple teeth engage with the inner surface.

In some aspects, a gerotor pump includes an inner rotor including multiple teeth, the inner rotor configured to rotate about a first longitudinal gerotor pump axis, and a hollow outer rotor surrounding the inner rotor, the outer rotor including a wall between an outer surface and an inner surface. The inner surface is configured to engage with the multiple teeth and to rotate about a second longitudinal gerotor pump axis, wherein a thickness of the wall along a circumference of the outer rotor is substantially equal.

This, and other aspects, can include one or more of the following features. The outer surface and the inner surface can have substantially identical contours. The pump can include a pump housing within which the inner rotor and the outer rotor are disposed, wherein the outer surface of the outer rotor defines gaps between the pump housing and the outer rotor. The pump housing can be a hollow pump housing. The pump housing can include an inlet end into which fluid is configured to flow and an outlet end out of which the fluid is configured to flow. The gaps between the pump housing and the outer rotor can be configured to allow the fluid to flow through. The fluid can be a wellbore fluid.

In some aspects, a gerotor pump includes an inner rotor including multiple teeth, the inner rotor configured to rotate about a first longitudinal gerotor pump axis, and a hollow outer rotor including a wall, the rotor configured to engage with the multiple teeth and to rotate about a second longitudinal gerotor pump axis. The gerotor pump also includes a pump housing within which the inner rotor and the outer rotor are disposed, wherein the outer surface of the outer rotor defines multiple gaps between the pump housing and the outer rotor.

This, and other aspects, can include one or more of the following features. The wall can include an inner surface and an outer surface having substantially identical contours. A thickness of the wall along a circumference of the outer rotor can be substantially equal. The pump housing can include an inlet end into which fluid is configured to flow and an outlet end out of which the fluid is configured to flow. The gaps between the pump housing and the outer rotor can be configured to allow the fluid to flow through. The fluid can be a wellbore fluid.

In some aspects, a method includes positioning a gerotor pump in a wellbore. The gerotor pump includes an inner rotor including multiple teeth, the inner rotor configured to rotate about a first longitudinal gerotor pump axis, and a hollow outer rotor including an outer surface and an inner surface having substantially identical contours. The inner surface is configured to engage with the multiple teeth and to rotate about a second longitudinal gerotor pump axis. The method also includes pumping wellbore fluid through the wellbore using the gerotor pump.

This, and other aspects, can include one or more of the following features. The gerotor pump can include a pump housing within which the inner rotor and the outer rotor are disposed, wherein the outer surface of the outer rotor defines gaps between the pump housing and the outer rotor. The method can include flowing fluid through the gaps. The fluid can include wellbore fluid. The fluid can include cooling fluid. A direction of flow of the cooling fluid in the gaps can be either concurrent with or counter-current to a direction of flow of the wellbore fluid through the pump. Positioning the gerotor pump in the wellbore can include positioning the gerotor pump downhole inside the wellbore. Positioning the gerotor pump in the wellbore can include positioning the gerotor pump at a surface of the wellbore. The gerotor pump can be a first gerotor pump. The method can include positioning a second gerotor pump in series with the first gerotor pump.

In some aspects, a gerotor pump includes an inner rotor including multiple teeth, the inner rotor configured to rotate about a first longitudinal gerotor pump axis, and a hollow outer rotor including an outer surface and an inner surface configured to engage with the multiple teeth and to rotate about a second longitudinal gerotor pump axis. The gerotor pump also includes a pump housing within which the inner rotor and the outer rotor are disposed, wherein at least a portion of the outer surface of the outer rotor defines gaps between the pump housing and the outer rotor.

This, and other aspects, can include one or more of the following features. The outer rotor can include a wall between the outer surface and the inner surface, wherein a thickness of the wall along a circumference of the outer rotor is substantially equal. A contour of the outer surface can be substantially identical to a contour of the inner surface. The pump housing can be a hollow pump housing. The pump housing can include an inlet end into which fluid is configured to flow and an outlet end out of which the fluid is configured to flow. The gaps between the pump housing and the outer rotor can be configured to allow the fluid to flow through. The inner surface can define multiple teeth, wherein a number of teeth defined by the inner surface is greater than a number of teeth included in the inner rotor. The inner rotor can define four teeth and the inner surface can define five teeth. The inner surface and the outer surface can have five-point star shapes. The housing can be substantially circular. The inner rotor can have a helical shape. The inner rotor and the outer rotor can be made of metal. The gerotor pump can include an elastomer layer disposed on an outer surface of the inner rotor, the elastomer layer contacting the inner surface of the outer rotor when the multiple teeth engage with the inner surface.

In some aspects, a gerotor pump includes an inner rotor comprising multiple teeth, the inner rotor configured to rotate about a first longitudinal gerotor pump axis, and a hollow outer rotor including an outer surface and an inner surface. The inner surface is configured to engage with the multiple teeth and to rotate about a second longitudinal gerotor pump axis. An elastomer layer is disposed on an outer surface of the inner rotor, the elastomer layer contacting the inner surface of the outer rotor when the multiple teeth engage with the inner surface.

This, and other aspects, can include one or more of the following features. The outer surface of the outer rotor and the inner surface of the outer rotor can have substantially identical contours.

The details of one or more implementations of the subject matter described in this disclosure are set forth in the accompanying drawings and the description that follows. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
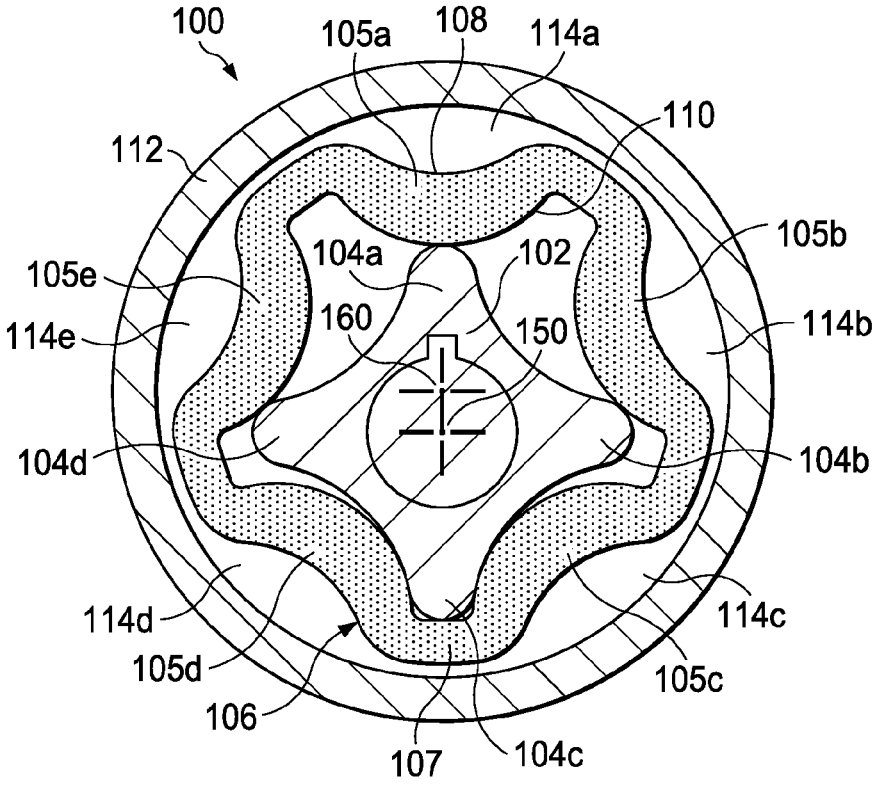
FIG. 1 is a schematic diagram of a cross-section of a first implementation of an example gerotor pump.

This disclosure relates to pumping fluids, for example, fluids flowing through wellbores. The field of application of this disclosure relates to fluid handling systems for pumps and compressors in oil and gas applications. For example, it is related to downhole artificial lift and surface production boost using positive displacement pumps.

In some wellbore applications, pumps are used to transport fluids such as hydrocarbons, mud, coolant, water, or other fluids. For example, a pump can be used to transport a fluid from a subterranean region to the surface. One such pump is the Electrical Submersible Pumps (ESP). An ESP is a centrifugal pump which can be very efficient at handling liquids. However, the performance of an ESP decreases very rapidly in the presence of gas. Other types of pump include the Progressive Cavity Pump (PCP) and the Twin-Screw Pump (TSP). PCPs and TSPs are types of positive displacement pumps which can handle multiphase mixtures with higher gas volume fraction. However, PCPs and TSPs are typically operated at a lower rotational speed (for example, less than 1000 RPM). Thus, a gearbox can be required to drive these types of pumps with a downhole electric motor. In addition, the design and manufacture of PCPs and TSPs can be complex and costly. In some cases, PCPs and TSPs are driven by a prime mover at the surface through a long rod string. This configuration can put limits on the application in terms of pump setting depth, wellbore dog-leg severity, and overall wellbore deviation.

This disclosure describes a gerotor pump design that can be used for downhole artificial lift or surface pressure boosting of oil and gas production operations. A gerotor pump typically includes an inner rotor disposed within an outer rotor that itself is disposed within a housing. The outer rotor has at least one more tooth than the inner rotor and has its longitudinal centerline axis positioned at a fixed offset from the longitudinal centerline axis of the inner rotor. As the rotors rotate about their respective longitudinal axes, fluid is drawn into a region between the inner rotor and the outer rotor. As rotation continues, the volume of the region decreases, forcing fluid out of the region. Typically, the outer surface of the outer rotor has a shape that is the same as the shape of the inner surface of the housing, and the outer surface of the outer rotor is flush with inner surface of the housing.

The gerotor pump described herein includes an outer rotor with a wall of a substantially equal thickness about a circumference or a cross-section of the outer rotor. The equal wall outer rotor provides space (for example, one or more gaps) between the outer rotor and the pump housing. This space can be used for active or passive fluid passage in addition to active or passive fluid passage in the space between the inner and outer rotors. In some implementations, the fluid within the space can be isolated from the pumped fluid located within the outer rotor. For example, the fluid in the space can be used to enhance heat transfer or for other operational purposes. In some implementations, the pump can include one or more stages in series to provide a desired pressure capacity. In some implementations, an elastomer-metal seal is achieved between the inner rotor and the outer rotor by coating the inner rotor surface with an elastomer. The gerotor pump design disclosed can be used for increasing the pressure of a single-phase fluid or a multiphase fluid mixture. Furthermore, the disclosed system can be used for multiphase pumping or wet gas compression, either downhole or at the surface.

Gerotor pumps parts can be simpler to mass produce than other types of pumps. For example, gerotor pumps can be manufactured without a casting process. A gerotor pump can have a relatively simple two-dimensional geometry, making it easier to manufacture, for example, using two-dimensional machining. In some cases, gerotor pumps can be operated with conventional electric motors with 50-60 Hz AC which can eliminate the need for gear reduction or timing gears. In addition, gerotor pumps can be more compact and efficient than other positive-displacement machines, such as PCPs or TSPs.

As described, an equal wall outer rotor allows space to be provided between the outer rotor and the pump housing. This can result in material, weight, and friction reduction. Furthermore, the equal wall outer rotor can allow capability for fluid circulation for heat management during pumping and compression and can also enable enhanced heat transfer. With high gas volume fraction fluids, heat generation during pumping or compression can be a design issue. The disclosed pump can provide more efficient heat transfer to improve pumping efficiency and reliability. In some cases, cooling may be required to increase pump run life and meet material specification. The disclosed gerotor pump can provide cooling of the pumped/compressed fluids that can also reduce energy consumption.

The disclosed gerotor pump can be used in applications such as wellbore applications, hydrocarbon recovery applications, aircraft applications, automotive applications, manufacturing applications, hydraulic applications, and other industrial applications. The gerotor pump can be used to transport fluid such as lubricant, hydrocarbons, wellbore fluid, fuel, cooling fluid, water, or other fluids in these or other applications. The gerotor pump can be used in oil refineries, water treatment facilities, dewatering operations for mining applications (for example, coal mining or other mining operations), and in other applications.

FIG. 1 is a schematic diagram of a cross-section of a first implementation of an example gerotor pump 100. The gerotor pump 100 includes an example inner rotor 102 that is disposed within an example hollow outer rotor 106. The inner rotor 102 and the outer rotor 106 are both disposed within a hollow pump housing 112. The inner rotor 102 includes multiple teeth 104*a-d*. In some cases, the inner rotor 102 has a shape similar to a toothed gear. The inner rotor 102 is configured to rotate about a first longitudinal gerotor pump axis 150. The example inner rotor 102 includes four teeth 104*a-d*, but in other implementations, the inner rotor 102 can include a different number of teeth, for example, five teeth, ten teeth, or other number of teeth.

The example outer rotor 106 is configured to rotate about a second longitudinal gerotor pump axis 160. The second longitudinal axis 160 is offset from and parallel to the first gerotor pump axis 150. The example outer rotor 106 includes an outer surface 108 and an inner surface 110. The inner surface 110 is configured to engage with the teeth 104*a-d* of the inner rotor 102. In some implementations, the outer surface 108 and the inner surface 110 have substantially identical contours. For example, a variance between a cross-sectional shape of the outer surface 108 and the inner surface 110 is less than or equal to 10%. The outer rotor 106 includes a wall 107 between the outer surface 108 and the inner surface 110. Because the outer surface 108 and the inner surface 110 have substantially identical contours, a thickness of the wall 107 along a circumference of the outer rotor 106 is substantially equal.

The inner surface 110 of the outer rotor 106 defines multiple teeth 105*a-e*. The example outer rotor 106 includes five teeth 105*a-e*, but in other implementations, the outer rotor 106 can include a different number of teeth, for example, four teeth, ten teeth, or other number of teeth. A number of teeth 105*a-e* defined by the inner surface 110 is greater than a number of teeth 104*a-d* included in the inner rotor 102. For example, in FIG. 1, the inner rotor 102 defines four teeth 104*a-d* and the inner surface 110 defines five teeth 105*a-e*. During operation, a tooth of the inner rotor 102 (for example, tooth 104*c*) engages a gap between two teeth of the outer rotor 106 (for example, teeth 105*c* and 105*d*) to cause the outer rotor 106 to rotate with the inner rotor 102. The rotation of the outer rotor 106 and inner rotor 102 transports fluid within the spaces between the inner rotor 102 and the inner surface 110 of the outer rotor 106, as described earlier. For example, the gerotor pump 100 can be positioned downhole and used to pump wellbore fluid toward the surface.

In some implementations, the inner rotor 102, the inner surface 110, or the outer surface 108 (or any combination of them) have a cross-section with a star shape. For example, in FIG. 1, the inner rotor 102 has a four-point star cross-sectional shape, and the inner surface 110 and the outer surface 108 have five-point star cross-sectional shapes. In some implementations, the inner rotor 102, the inner surface 110, or the outer surface 108 (or any combination of them) have a cross-sectional shape that is smooth, symmetrical, irregular, or another shape. The inner rotor 102, the inner surface 110, or the outer surface 108 (or any combination of them) can have a longitudinal shape that is helical, conical, beveled, smooth, irregular, or another shape. The inner rotor 102 and the outer rotor 106 can be made of plastic, composite, metal (for example, steel, aluminum, or another metal), or another material. In some implementations, both the inner rotor 102 and the outer rotor 106 are all metal, resulting in a sliding metal-to-metal seal in operation.

The example gerotor pump 100 includes an example hollow pump housing 112 within which the inner rotor 102 and the outer rotor 106 are disposed. The outer surface 108 of the outer rotor 106 can define gaps 114*a-e* between the pump housing 112 and the outer rotor 106. The example gaps 114*a-e* are created due to the inner surface 110 and the outer surface 108 having substantially the same shape. The pump housing 112 can be substantially circular as in FIG. 1, or have another shape. Example gerotor pump 100 includes five gaps 114*a-e*, but in other implementations, the gerotor pump 100 can include another number of gaps, for example, four gaps, five gaps, ten gaps, or other number of gaps. In some implementations, one or more gaps have a different size or a different shape than another gap. In some implementations, gaps are defined in some portions of the gerotor pump 100 but not in other portions. For example, some portions of the outer rotor 106 can be shaped to define gaps between the outer rotor 106 and the pump housing 112, and other portions of the outer rotor 106 are flush with the pump housing 112 such that no gaps are defined. In some implementations, gaps are defined between the pump housing 112 and the outer rotor 106, and the wall 107 does not have a substantially equal thickness.

In some implementations, the outer rotor 106 does not contact or slide against the pump housing 112. The gaps 114*a-e* between the pump housing 112 and the outer rotor 106 can be configured to allow a fluid to be contained within the gaps 114*a-e* or flowed through the gaps 114*a-e* (or both). The fluid can be, for example a lubricating fluid, a wellbore fluid, a cooling fluid, water, mud, hydrocarbons, or another fluid. For example, a lubricating fluid in the gaps 114*a-e* between the outer rotor 106 and the housing 112 can reduce friction. This friction reduction can enhance energy efficiency of the pumping system. For example, for a gerotor pump 100 positioned downhole to pump a wellbore fluid, a lubricating fluid in the gaps 114*a-e* can reduce wear and increase the lifetime of the pump 100. In some cases, a fluid (for example, a cooling fluid) in the gaps 114*a-e* between the outer rotor 106 and the housing 112 can enhance heat transfer. For example, for a gerotor pump 100 positioned downhole to pump a wellbore fluid, a cooling fluid in the gaps 114*a-e* can reduce effects due to heat generation and reduce energy consumption of the pump 100.

Figure 2:
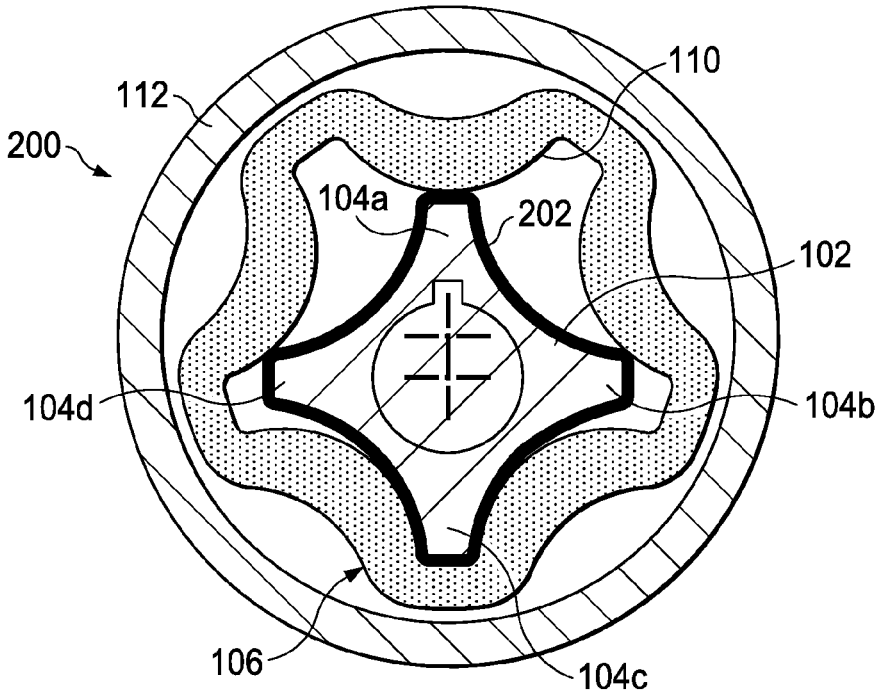
FIG. 2 is a schematic diagram of a cross-section of a second implementation of an example gerotor pump.

FIG. 2 is a schematic diagram of a cross-section of a second implementation of an example gerotor pump 200. Example gerotor pump 200 is substantially similar to gerotor pump 100. Gerotor pump 200 includes an elastomer layer 202 disposed on an outer surface of the inner rotor 102. In some implementations, the elastomer layer 202 provides a metal-to-elastomer seal between the outer surface of the inner rotor 102 and the inner surface 110 of the outer rotor 106. In some cases, the elastomer layer 202 can be made by bonding a layer of elastomer, rubber, polymer, or another material on the outer surface of the inner rotor 102. For example, the elastomer layer 202 can be Viton, EPDM, Highly Saturated Nitrile (HSN), Aflas, or another elastomer. In some implementations, elastomer is bonded to some portions of the outer surface of the inner rotor 202 and not to other portions of the outer surface of the inner rotor 202. In some implementations, the elastomer layer 202 is a substantially uniform layer, and in some implementations, the elastomer layer 202 has portions of different thicknesses. In some implementations, the elastomer layer 202 can contact the inner surface 110 of the outer rotor 106 when the teeth 104*a-d* engage with the inner surface 110.

Figure 3:
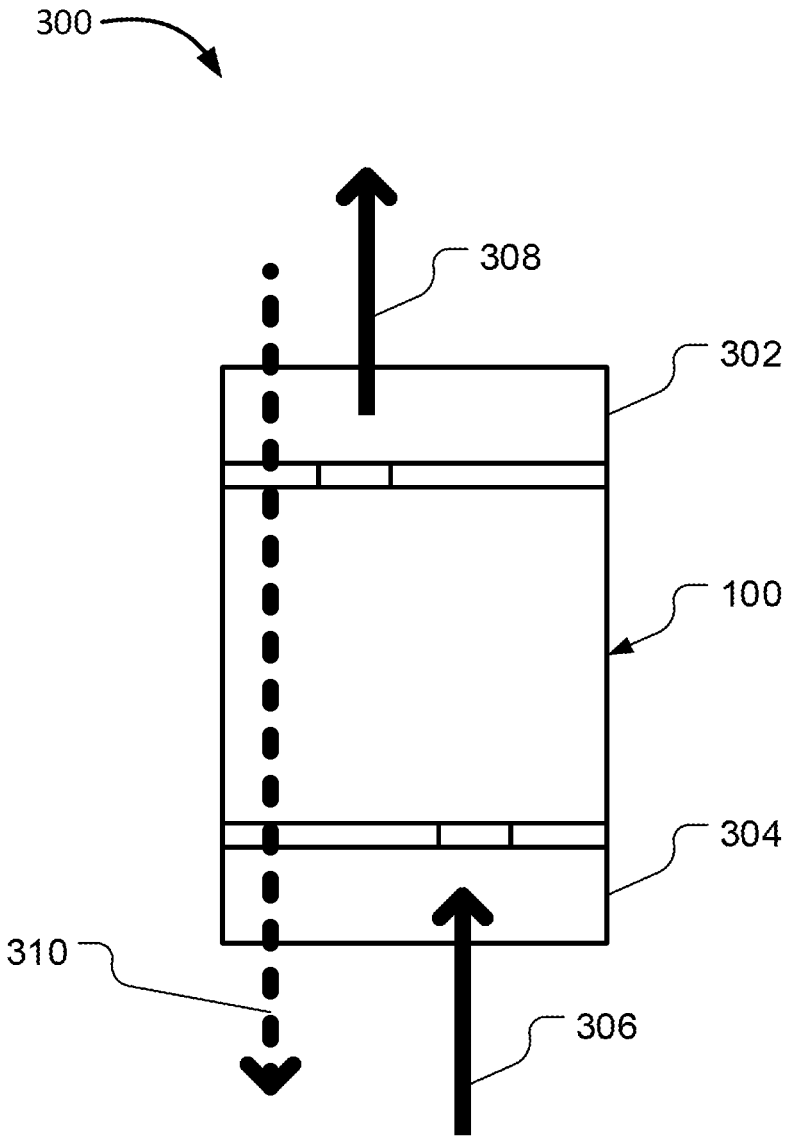
FIG. 3 is a schematic diagram of an example gerotor pump system.

FIG. 3 is a schematic diagram of an example gerotor pump system 300. The pump system 300 can include one or more gerotor pumps such as gerotor pump 100 or gerotor pump 200. The example pump system 300 includes an inlet end 304 into which fluid is configured to flow (shown by inlet flow 306) and an outlet end 302 out of which fluid is configured to flow (shown by outlet flow 308). In some implementations, the inlet end 304 or the outlet end 302 (or both) are incorporated within the gerotor pump 100. For example, the inlet end 304 or the outlet end 302 (or both) can be part of the pump housing 112. The pump system 300 can receive a first fluid into the inlet end 304 and pump the first fluid out of the outlet end 302. In some implementations, the inlet end or outlet end of a first gerotor pump can be coupled to the outlet end or inlet end of a second gerotor pump, respectively. The pump system 300 can be used in a wellbore environment. For example, the pump system 300 can receive a wellbore fluid in the inlet end 304 and pump the wellbore fluid out of the outlet end 302. In this manner, the pump system 300 can be used to transport a fluid from a subterranean region to the surface, for example.

In some implementations, a second fluid is configured to flow within the gaps in the gerotor pump 100 (for example, the gaps 114*a-e*). In FIG. 3, an example flow of the second fluid is shown by gap flow 310. In some implementations, a direction of flow 310 of the second fluid in the gaps is either concurrent with or counter-current to a direction of flow 306, 308 of the first fluid through the pump. Fluid passage in the gaps between outer rotor and pump housing can be either passive or active, concurrent or countercurrent with the pumped fluid direction, for enhancing heat transfer (for example, cooling or heating), for other operational purposes (for example, well natural production when pump is non-operational, chemical bullheading, or other operational purposes.). In some implementations, the second fluid has the same composition as the first fluid or a different composition. In some implementations, the second fluid is a cooling fluid, a wellbore fluid, or another fluid.

Figure 4:
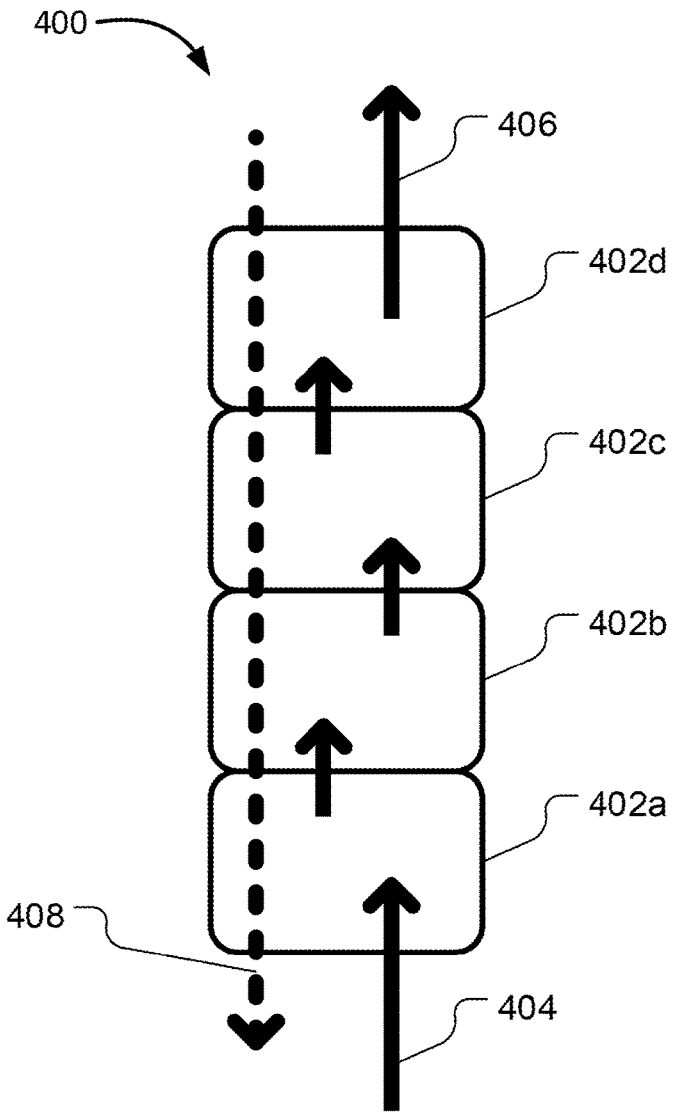
FIG. 4 is a schematic diagram of an example multistage gerotor pump system.

FIG. 4 is a schematic diagram of an example multistage gerotor pump system 400. The example pump system 400 includes one or more pump stages 402*a-d* that are positioned in series to pump fluid. For example, a fluid can enter the pump system 400 (shown as inlet flow 404) and be pumped through the stages 402*a-d* to an outlet (shown with outlet flow 406). Example pump system 400 as shown in FIG. 4 has four stages 402*a-d*, but in other implementations more or fewer pump stages can be used (for example, one stage, two stages, four stages, ten stages, or other number of stages.). In some implementations, the one or more stages 402*a-d* are one or more gerotor pumps such as gerotor pump 100 or gerotor pump 200. In some implementations, the one or more stages 402*a-d* are one or more pump systems such as pump system 300. The stages 402*a-d* can be the same or have different characteristics. In some implementations, the multiple stages 402*a-d* can be in series to achieve one or more desired differential pressures. For example, the outlet of a stage can be coupled to the inlet of an adjacent stage, or the inlet of one stage and be coupled to the outlet of an adjacent stage (or both). Multiple stages in series can reduce slippage and allow the pump system 400 to work against high pressures. In some implementations, a second fluid is configured to flow within the gaps in pump stages 402*a-d* (for example, the gaps 114*a-e* in gerotor pump 100 or gerotor pump 200). The second fluid can flow between multiple stages 402*a-d*, as shown in FIG. 4 with gap flow 408. Fluid passage in the gaps can be either passive or active or concurrent or countercurrent with the pumped fluid direction. The pump system 400 can be used in a wellbore environment, for example, to pump a wellbore fluid from a subterranean region to the surface. The multiple stages 402*a-d* can be configured to provide pumping characteristics suitable for a wellbore application, for example, desired flow rate, desired differential pressures, or other pumping characteristics.

Figure 5:
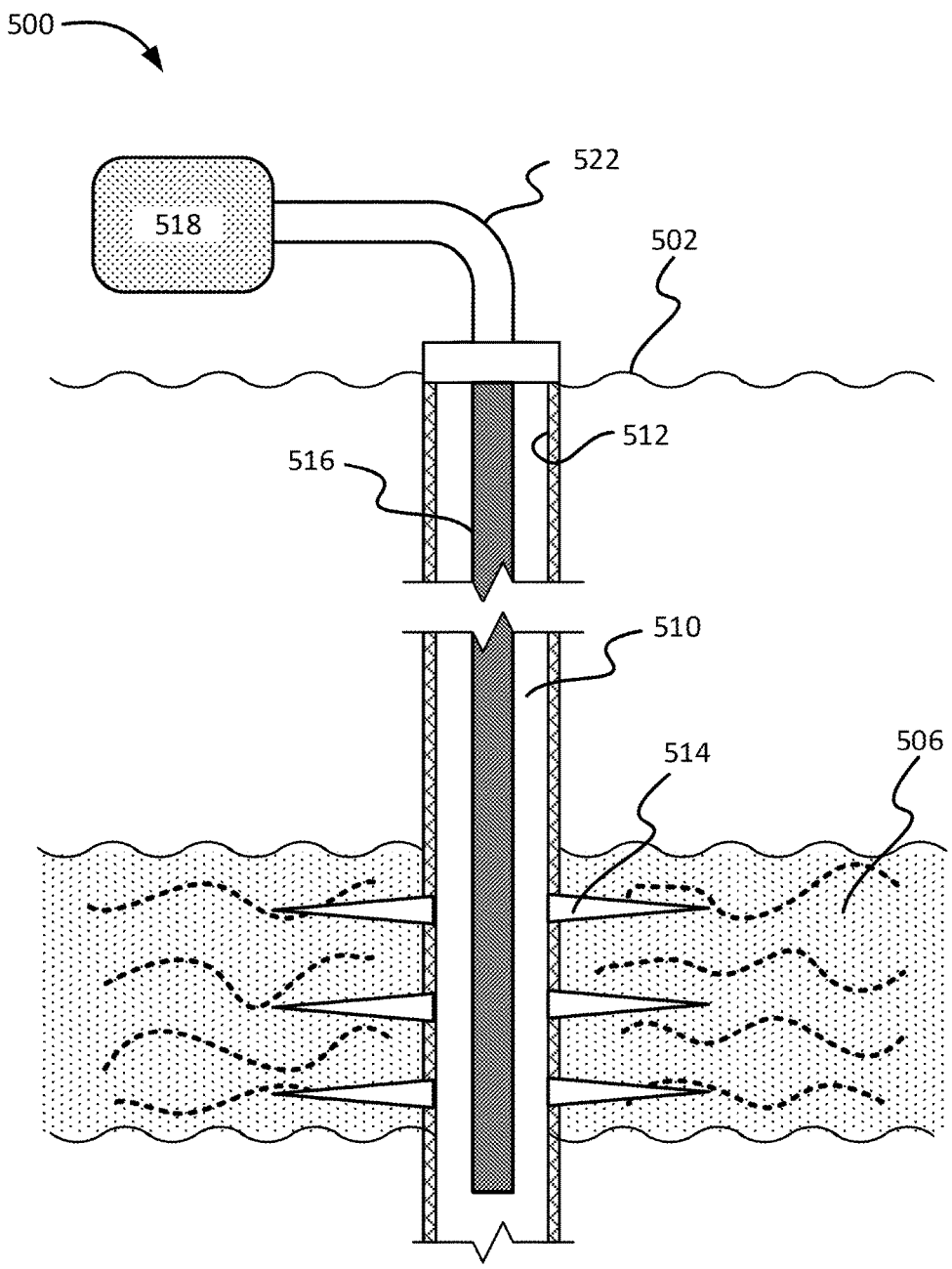
FIG. 5 is a diagram illustrating an example well system.

FIG. 5 is a diagram illustrating an example well system 500. The example well system 500 includes a wellbore 510 below the terranean surface 502. In some implementations, the wellbore 510 is cased by a casing 512. A wellbore 510 can include any combination of horizontal, vertical, curved, or slanted sections (or any combination of them). The well system 500 includes an example working string 516 that resides in the wellbore 510. The working string 516 terminates above the surface 502. The working string 516 can include a tubular conduit of jointed or coiled tubing (or both) configured to transfer materials into or out of the wellbore 510 (or both). The working string 516 can communicate a fluid 518 into or through a portion of the wellbore 510. In some implementations, tubing 522 communicates the fluid 518 to the working string 516. In some implementations, the well system 500 includes multiple wellbores and multiple working strings.

The casing 512 can include perforations 514 in a subterranean region and the fluid 518 can flow into a formation 506 through the perforations 514. The fluid 518 can be used to recover hydrocarbons from formation 506. Additionally, resources (for example, oil, gas, or others) and other materials (for example, sand, water, or others) may be extracted from the formation 506. The well system 500 can recover at least a portion of the hydrocarbons in the subterranean formation 506. The casing 512 or the working string 516 can include a number of other systems and tools not illustrated in the figures.

A gerotor pump or pump system like those described in this disclosure can be included in the well system 500. For example, a gerotor pump can be configured to pump fluid (for example, fluid 518) into the wellbore 510, pump fluid out of the wellbore 510, or pump fluid through the wellbore 510. A gerotor pump can be positioned at the surface 502 of the wellbore 510 or positioned downhole inside the wellbore 510. A gerotor pump can be connected to components such as the tubing 522, the working string 516, or other components. For some downhole applications, the gerotor pump can be driven by a surface motor via a rod, or a downhole submersible motor (for example, as an Electric Submersible Gerotor Pump). Well system 500 is an example; a gerotor pump or pump system such as that disclosed herein can be used in other well systems and in other well system applications.

One such application of the gerotor pump is in oilfield applications, in conjunction with an electric submersible pump (ESP). An ESP installed downhole in a wellbore provides artificial lift to lift well fluids from downhole to the surface. Alternatively, or in addition, the ESP is used on the surface to transfer fluid from the well site to other equipment or facility for further processing. An ESP can include, for example, a sensor sub, an electric motor, a protector (or seal section), and a centrifugal pump. The pump section includes rotating impellers and static diffusers stacked one above the other to provide a multi-stage system, which generates the required head or pressure boost for the specific ESP application. During production of well fluid with high-gas content, the ESP performance decreases due to presence of the high volume of gas. Installing a gerotor compressor (for example, the gerotor pump described in this disclosure) upstream of the pump can compress the gas mixture before the gas mixture enters the production pump, thereby enhancing pump performance.

In implementations in which the fluid is or includes gas, for example, in a high gas volume fraction with relatively small amount of liquids, compressing the gas to smaller volumes, either at the surface or downhole (or both), is beneficial. In the case of downhole applications and in surface applications in which a pump is attached downstream of the compressor, compressing the gas ensures the fluid can flow through the pump without disrupting pump performance. In addition, at the surface, the compressor can be a standalone device operating to reduce the gas volume for storage or transportation to a different facility.

Compressing a fluid with high gas content can result in heat generation causing an increase in the fluid temperature. Such an increase in temperature represents an energy loss in the system. Unless the excess heat is removed, overheating can occur leading to equipment failure and subsequently higher operating costs. Energy loss can be minimized and system efficiency improved when compression is implemented under isothermal or near-isothermal conditions. For a gas undergoing compression, the area under the pressure versus volume curve represents a quantity of work done on the gas to achieve compression. Typically, most gas compressions are adiabatic. For the same volume compression ratio, comparison of the area under the pressure versus volume curve for adiabatic and isothermal compression shows that the former area is greater than the latter area, indicating that more work/energy is required for adiabatic compression compared to isothermal compression.

Figure 6:
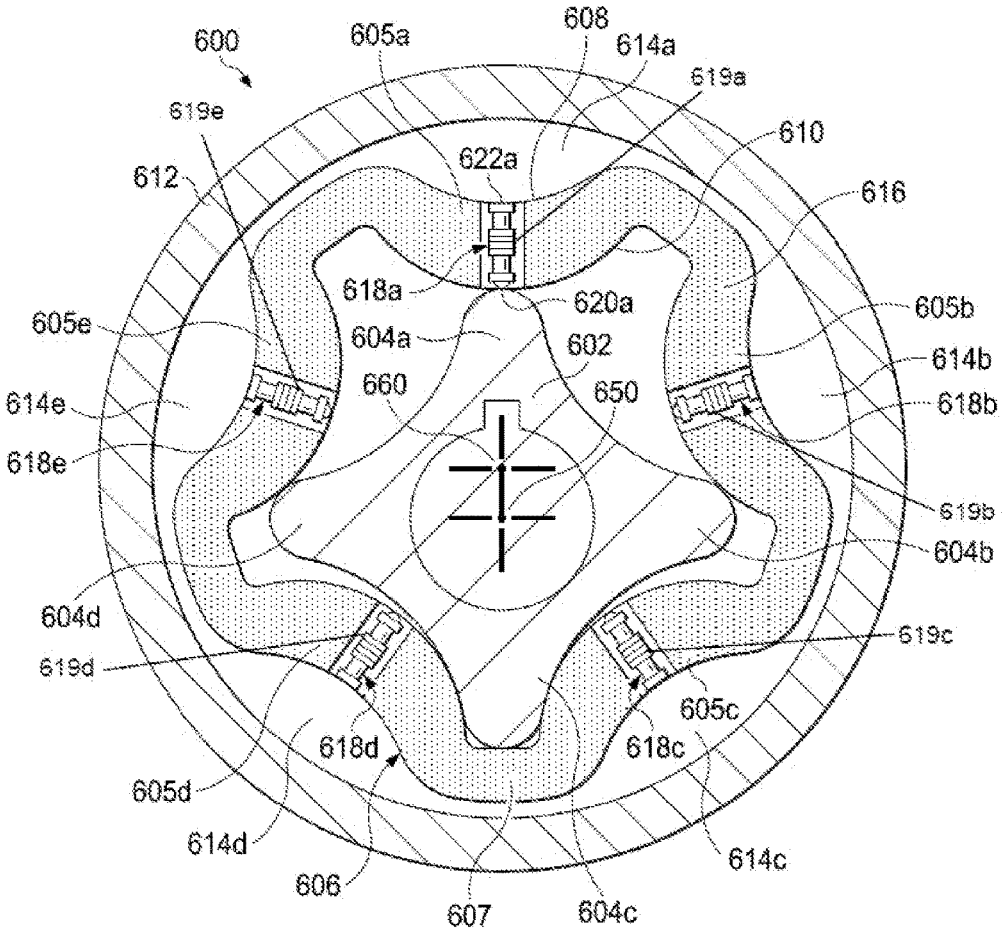
FIG. 6 is a schematic diagram of a cross-section of a third implementation of an example gerotor pump.

FIG. 6 is a schematic diagram of a cross-section of a third implementation of an example gerotor pump 600 that can be implemented in oilfield applications as a compressor. The gerotor pump 600 can be implemented as an equal-wall with the gas compressor used in producing high-gas content fluids. As described later, cooling fluids can be circulated in the gaps between the outer surface of an outer rotor 606 of the gerotor pump 600 and an inner surface of a hollow pump housing 612 and further into a cavity 616 between the inner surface of the outer rotor 606 and an outer surface of the inner rotor 602. The cooling fluids decrease a temperature of the wet gas being compressed resulting in isothermal or near-isothermal compression and improved compression efficiency of the gerotor pump 600.

Example gerotor pump 600 is substantially similar to gerotor pump 100. Similar to the gerotor pump 100 described earlier, the gerotor pump 600 includes an example inner rotor 602 that is disposed within an example hollow outer rotor 606. The inner rotor 602 and the outer rotor 606 are both disposed within a hollow pump housing 612. The inner rotor 602 includes multiple teeth 604*a-d*. In some cases, the inner rotor 602 has a shape similar to a toothed gear. The inner rotor 602 is configured to rotate about a first longitudinal gerotor pump axis 650. The example inner rotor 602 includes four teeth 604*a-d*, but in other implementations, the inner rotor 602 can include a different number of teeth, for example, five teeth, ten teeth, or other number of teeth.

The example outer rotor 606 is configured to rotate about a second longitudinal gerotor pump axis 660. The second longitudinal axis 660 is offset from and parallel to the first gerotor pump axis 650. The example outer rotor 606 includes an outer surface 608 and an inner surface 610. The inner surface 610 is configured to engage with the teeth 604*a-d* of the inner rotor 602. In some implementations, the outer surface 608 and the inner surface 610 have substantially identical contours. The outer rotor 606 includes a wall 607 between the outer surface 608 and the inner surface 610. Because the outer surface 608 and the inner surface 610 have substantially identical contours, a thickness of the wall 607 along a circumference of the outer rotor 606 is substantially equal.

The inner surface 610 of the outer rotor 606 defines multiple teeth 605*a-e*. The example outer rotor 606 includes five teeth 605*a-e*, but in other implementations, the outer rotor 606 can include a different number of teeth, for example, four teeth, ten teeth, or other number of teeth. A number of teeth 605*a-e* defined by the inner surface 610 is greater than a number of teeth 604*a-d* included in the inner rotor 602. For example, in FIG. 6, the inner rotor 602 defines four teeth 604*a-d* and the inner surface 610 defines five teeth 605*a-e*. During operation, a tooth of the inner rotor 602 (for example, tooth 604*c*) engages a gap between two teeth of the outer rotor 606 (for example, teeth 605*c* and 605*d*) to cause the outer rotor 606 to rotate with the inner rotor 602. The rotation of the outer rotor 606 and inner rotor 602 transports fluid within the spaces between the inner rotor 602 and the inner surface 610 of the outer rotor 606, as described earlier. For example, the gerotor pump 600 can be positioned downhole and used to pump wellbore fluid toward the surface.

In some implementations, the inner rotor 602, the inner surface 610, or the outer surface 608 have a cross-section with a star shape. For example, in FIG. 6, the inner rotor 602 has a four-point star cross-sectional shape, and the inner surface 610 and the outer surface 608 have five-point star cross-sectional shapes. In some implementations, the inner rotor 602, the inner surface 610, or the outer surface 608 have a cross-sectional shape that is smooth, symmetrical, irregular, or another shape. The inner rotor 602, the inner surface 610, or the outer surface 608 can have a longitudinal shape that is helical, conical, beveled, smooth, irregular, or another shape. The inner rotor 602 and the outer rotor 606 can be made of plastic, composite, metal (for example, steel, aluminum, or another metal), or another material. In some implementations, both the inner rotor 602 and the outer rotor 106 are all metal, resulting in a sliding metal-to-metal seal in operation.

The gerotor pump 600 includes a hollow pump housing 612 within which the inner rotor 602 and the outer rotor 606 are disposed. The outer surface 608 of the outer rotor 606 can define gaps 614*a-e* between the pump housing 612 and the outer rotor 606. The example gaps 614*a-e* are created due to the inner surface 610 and the outer surface 608 having substantially the same shape. The pump housing 612 can be substantially circular as in FIG. 6, or have another shape. Example gerotor pump 600 includes five gaps 614*a-e*, but in other implementations, the gerotor pump 600 can include another number of gaps, for example, four gaps, five gaps, ten gaps, or other number of gaps. In some implementations, one or more gaps have a different size or a different shape than another gap. In some implementations, gaps are defined in some portions of the gerotor pump 600 but not in other portions. For example, some portions of the outer rotor 606 can be shaped to define gaps between the outer rotor 606 and the pump housing 612, and other portions of the outer rotor 606 are flush with the pump housing 612 such that no gaps are defined. In some implementations, gaps are defined between the pump housing 612 and the outer rotor 606, and the wall 607 does not have a substantially equal thickness.

In some implementations, the outer rotor 606 does not contact or slide against the pump housing 612. The gaps 614*a-e* between the pump housing 612 and the outer rotor 606 can be configured to allow a fluid to be contained within the gaps 614*a-e* or flowed through the gaps 614*a-e* or both. The fluid can be, for example a lubricating fluid, a wellbore fluid, a cooling fluid, water, mud, hydrocarbons, or another fluid. For example, a fluid (for example, a cooling fluid) in the gaps 614*a-e* between the outer rotor 106 and the housing 112 can enhance heat transfer. For example, for a gerotor pump 600 positioned downhole to pump a wellbore fluid, a cooling fluid in the gaps 614*a-e* can reduce effects due to heat generation and reduce energy consumption of the pump 100.

In some implementations, the cooling fluid flowed through the gaps 614*a-e* can be flowed into a cavity 616, that is, a space between the inner surface of the outer rotor 606 and an outer wall of the inner rotor 602. To do so, the gerotor pump 600 can include multiple fluid injection nozzles, for example, a first fluid injection nozzle 618*a*, a second fluid injection nozzle 618*b*, a third fluid injection nozzle 618*c*, a fourth fluid injection nozzle 618*d*, a fifth fluid injection nozzle 618*e* or more or fewer fluid injection nozzles. Each nozzle can be positioned at or near a center of a tooth of the outer rotor 602. For example, the outer rotor 602 can include five teeth, namely, 605*a-e*. Each tooth can include two end portions, each curving away from a center of the outer rotor 602, and a central portion that connects the two end portions and that curves inward toward the center of the outer rotor 602. Each nozzle can be installed at or near the central portion of each tooth. The sum of the surface areas of the nozzle outlets is selected to be small compared to an inner surface area of the outer rotor 606 to minimize compression losses. Alternatively or in addition, each nozzle can be positioned in the outer rotor 606 such that each nozzle inlet is flush with an outer surface of the outer rotor 606 or each nozzle outlet is flush with an inner surface of the outer rotor 606 or both to reduce secondary flow losses due to discontinuities in the outer rotor surface geometry.

Many other configurations, positions and orientations of the nozzles are possible. For example, a nozzle need not be installed in each tooth of the outer rotor 602. In the example described earlier, a longitudinal axis of the nozzle is substantially aligned with a radius of the outer rotor 602. In alternative implementations, the longitudinal axis of one or more or all the nozzles can be at an angle to the radius of the outer rotor 602. Also, in the example described earlier, the longitudinal axis of the nozzle is substantially parallel to a cross-sectional plane that is perpendicular to a longitudinal axis of the outer rotor 602. In alternative implementations, the longitudinal axis of one or more or all the nozzles can be at an angle to the cross-sectional plane such that one or more or all the nozzles inject the cooling fluid either upward or downward into the cavity 616. In some implementations, a nozzle can be positioned at an end of a tooth to instead of or in addition to a central portion of the tooth. In some implementations, multiple nozzles can be installed at multiple cross-sectional planes, each of which is perpendicular to the longitudinal axis of the outer rotor 602. Doing so can allow injecting cooling fluids into different regions of the gerotor pump 600 along the longitudinal axis, simultaneously or at different times.

Each nozzle can include an inlet end (for example, inlet end 620*a* for nozzle 618*a*) in a gap (for example, gap 614*a*) and an outlet end (for example, outlet end 622*a* for nozzle 618*a*) in the cavity 616. Each nozzle can atomize fluid (for example, the cooling fluid or other fluid) flowed through the nozzle from the gap (for example, the gap 614*a*) into the cavity 616. As described later, in some implementations, the gerotor pump 600 can be implemented to compress fluid in the cavity 616. By flowing cooling fluid through the gaps 614*a-e* and the nozzles 618*a-e* and by atomizing the cooling fluid using the nozzles 618*a-e*, the temperature of the fluid being compressed can be decreased, thereby improving the isothermal efficiency of the fluid compression.

As described earlier, each nozzle atomizes the fluid and injects the atomized fluid into the cavity 616. To do so, each nozzle can include a cavity of decreasing cross-sectional area that can atomize the fluid based on flow rate and pressure in the gaps 614*a-e*. A nozzle can be pressure-actuated, similar to a pressure relief valve or gas lift valve, for example, using a spring of a pressurized gas chamber. Alternatively or in addition, a nozzle can be passively activated using a check valve that allows cooling fluid to pass from the gaps 614*a-e* into the cavity 616 and to prevent gas from escaping from the cavity 616 into the gaps 614*a-e*. In such a nozzle, fluid flow from the gaps 614*a-e* goes through the check valve, the nozzle section and into the cavity 616. The one-way check valve allows fluid in one direction only once the minimum differential pressure is achieved. When the pressure downstream of the nozzle is greater than in the gaps 614*a-e*, for example, after the fluid is compressed, the valve closes. The decreasing cross-sectional area accelerates and atomizes the cooling fluid into a spray which is injected into the cavity 616. In some implementations, one or more or all nozzles can be actively controlled using one or more of electric, hydraulic or pneumatic actuators, for example, actuators 619*a*, 619*b*, 619*c*, 619*d*, and 619*e*, that operate valves remotely using programmable controllers (for example, PLCs, computer systems, other programmable controllers or combinations of them).

In some implementations, the actuating settings for the nozzles can be the same or different. That is, each nozzle can be turned on or off separately or simultaneously. For example, each nozzle can have a threshold pressure at which the nozzle is activated, that is, opened to flow cooling fluids. As the inner rotor 602 rotates within the outer rotor 606, some portions of the cavity 616 will have a lower pressure compared to a pressure in corresponding portions of the gaps 614*a-e* due to gas expansion. In contrast, other portions of the cavity 616 will have a higher pressure compared to a pressure in corresponding portions of the gaps 614*a-e* due to gas compression. Because the threshold pressure is satisfied for nozzles in the portions with lower pressure, the nozzles open. Conversely, because the threshold pressure is not satisfied for nozzles in the portions with higher pressure, the nozzles remain closed. As the inner rotor 602 continues to rotate, the pressure varies, that is, the pressure in the portions with lower pressure increases and the pressure in the portions with higher pressure decreases. Such variation in pressure causes the nozzles that were previously closed to open and nozzles that were previously open to close.

Figure 7:
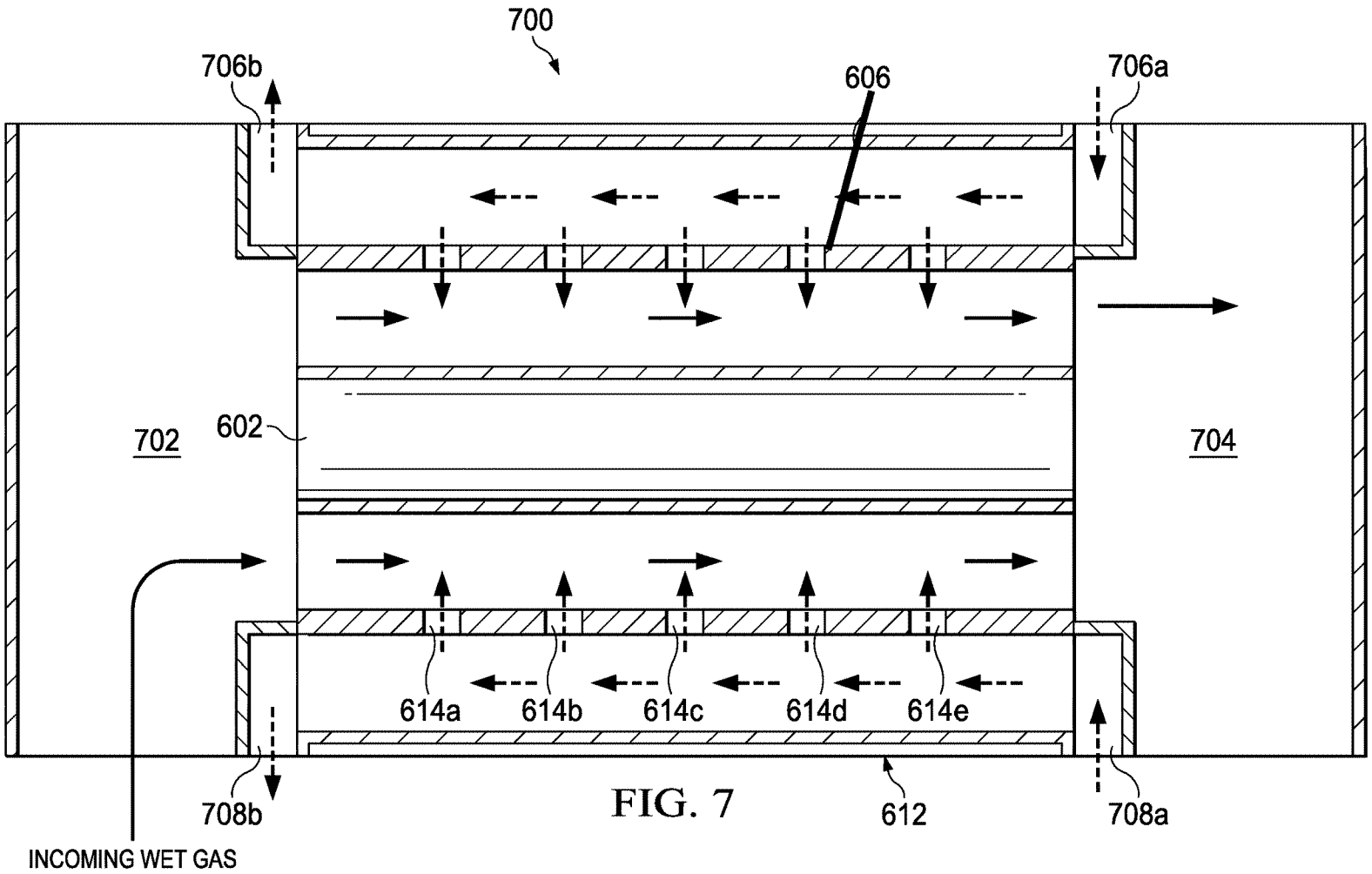
FIG. 7 is a schematic diagram illustrating a cooling process implemented using the gerotor pump of FIG. 6.

FIG. 7 is a schematic diagram illustrating a cooling process implemented using the gerotor pump 600. In some implementations, the gerotor pump 600 can be installed within a tubing 700 through which wet gas is flowed. For example, the wet gas is flowed into the gerotor pump 600 via the inlet 702. The gas flows through the cavity 616 between the outer surface of the rotor 602 and the inner surface of the outer rotor 606. A rotation of the inner rotor 602 within the outer rotor 606 causes gas compression. The compressed gas exits the gerotor pump 600 via the outlet 704. To control a temperature of the compressed gas, the cooling fluid can be flowed through the gaps 614*a-e* from an inlet (for example, inlet 706*a* or 708*a* or both) to an outlet (for example outlet 706*b* or outlet 708*b* or both, respectively). In some implementations, all flow parameters, both of the cooling fluid and the fluid being compressed, can be monitored or controlled (or both) to optimize compression efficiency. Such parameters can include, for example, gas flow rate and temperature, gerotor pump temperature, cooling fluid flow rate and temperature, nozzle activation duration, to name a few. The flow parameters can be controlled such that each nozzle is activated to inject cooling fluid for a duration that is sufficient to achieve a meaningful decrease in the temperature of the compressed gas. For example, the injection duration can be a function of a volume of each gap and volumetric flow rate through the gaps 614*a-e*.

A direction of flow of the cooling fluid through the gerotor pump 600 can be opposite a direction of flow of the wet gas through the gerotor pump 600. Such a counter-flow can enhance heat removal from the gerotor pump 600. Also, placing the cooling fluid inlet nearer to the gerotor pump 600 outlet rather the gerotor pump 600 inlet can allow part of the cooling fluid to be injected through the nozzles into the cavity 616. That said, in some implementations, a direction of flow of the cooling fluid through the gerotor pump 600 can the same as a direction of flow of the wet gas through the gerotor pump 600. All or at least a portion of the cooling fluid can be injected into the cavity 616 by activating one or more nozzles to inject cooling fluid into the cavity 616. In some implementations, more than one cooling fluid inlet or cooling fluid outlet can be implemented.

In some implementations, the gerotor pump 600 includes an elastomer layer (not shown) disposed on an outer surface of the inner rotor 602. In some implementations, the elastomer layer provides a metal-to-elastomer seal between the outer surface of the inner rotor 602 and the inner surface 610 of the outer rotor 606. In some cases, the elastomer layer can be made by bonding a layer of elastomer, rubber, polymer, or another material on the outer surface of the inner rotor 602. For example, the elastomer layer 602 can be Viton, EPDM, Highly Saturated Nitrile (HSN), Aflas, or another elastomer. In some implementations, elastomer is bonded to some portions of the outer surface of the inner rotor 602 and not to other portions of the outer surface of the inner rotor 602. In some implementations, the elastomer layer is a substantially uniform layer, and in some implementations, the elastomer layer has portions of different thicknesses. In some implementations, the elastomer layer can contact the inner surface 610 of the outer rotor 606 when the teeth 604*a-d* engage with the inner surface 610.

Figure 8:
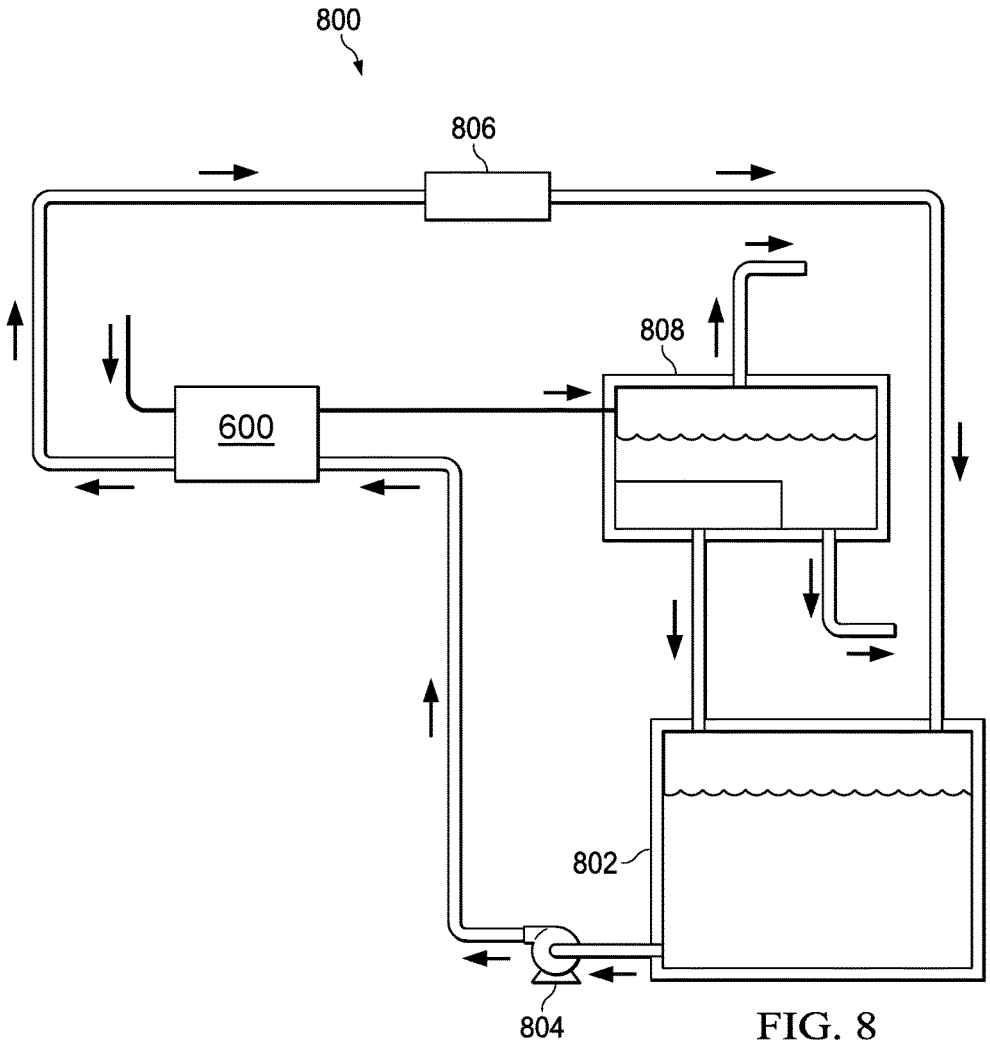
FIG. 8 is a schematic diagram illustrating a circulation system to flow cooling fluid through the gerotor pump of FIG. 6.

FIG. 8 is a schematic diagram illustrating a circulation system 800 to flow cooling fluid through the gerotor pump 600. The circulation system 800 can include tanks, pumps, heat exchangers, sensors and controllers (for example, computer systems or other controllers) to control flow of the cooling fluid through the gerotor pump 600. In some implementations, a cooling fluid (for example, water) from the coolant tank 802 is injected into the gaps 614*a-e* of the gerotor pump 600 by the feed pump 804. Wet gas enters the suction chambers of the gerotor pump 600, as described earlier with reference to FIG. 7. The cooling fluid is sprayed into the wet gas by activating the nozzles as described earlier. The cooling fluid exits the gerotor at a higher temperature than at the inlet. The high temperature cooling fluid is flowed to a chiller 806 which reduces the temperature of the cooling liquid, and flows the liquid to the coolant tank 802 for re-circulation using the feeder pump 804. In some implementations, to reduce depletion of the cooling fluid in the coolant tank 802 due to the volume sprayed into the gerotor pump 600, the mixture of cooling fluid and wet gas exiting the gerotor pump 600 is fed into a 3-phase separator 808, which separates the mixture into its constituent phases. The cooling fluid recovered from this separation process is fed back to the coolant tank 802.

In some implementations, the circulation system 800 can be implemented at the surface while, in other implementations, the circulation system 800 can be implemented below the surface. In implementations in which the gerotor pump 600 is implemented in a deep well, the well fluid can be used as the production fluid. For example, a portion of the well fluid stream can be metered and injected through the nozzles into the cavity 616 resulting in a temperature reduction of the post-compressed well fluid.

Figure 9:
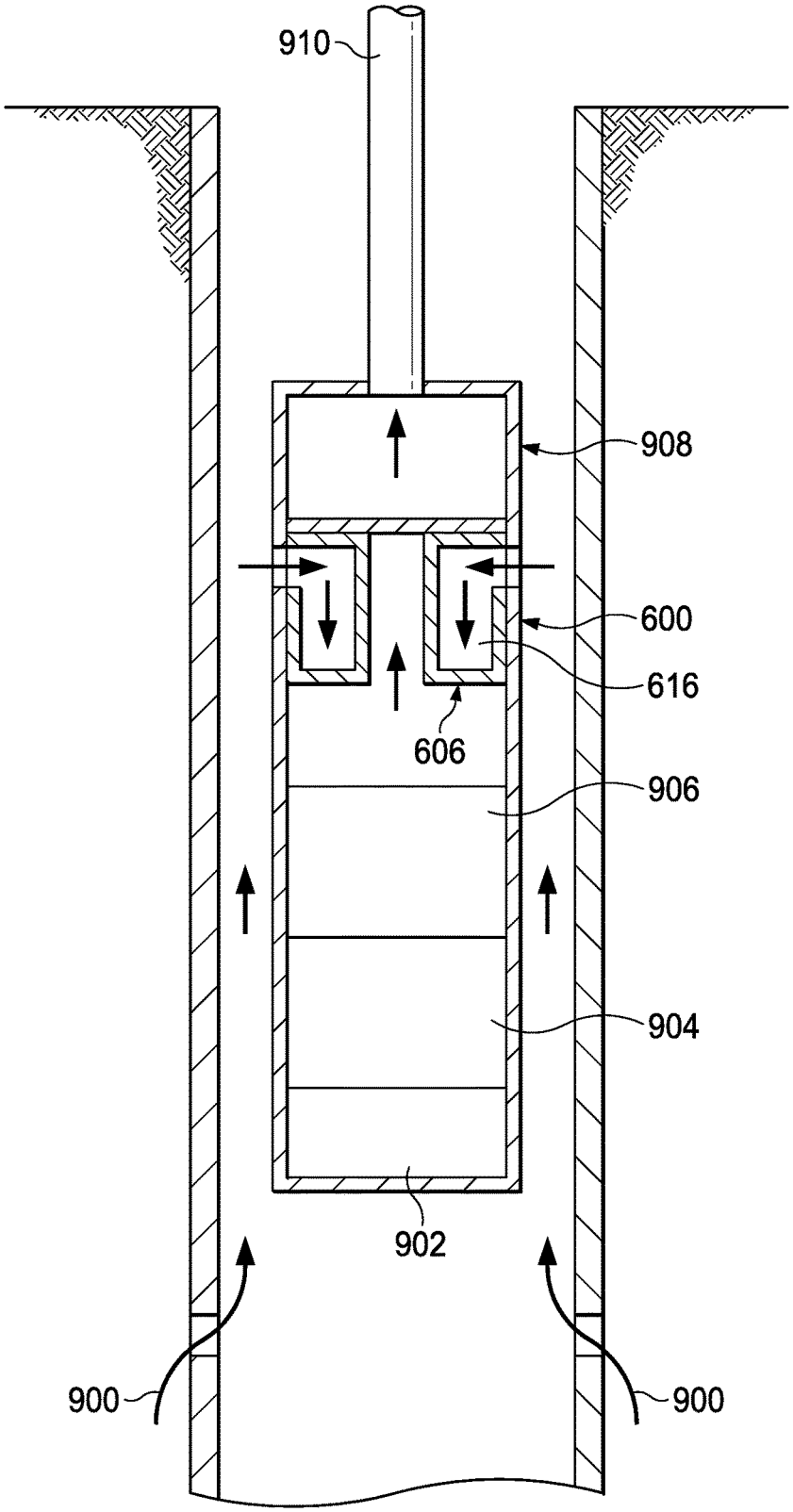
FIG. 9 is a schematic diagram illustrating an implementation of the gerotor pump of FIG. 6 with an electric submersible pump in a wellbore.

FIG. 9 is a schematic diagram illustrating an implementation of the gerotor pump 600 with an electric submersible pump in a wellbore. As shown in FIG. 9, the gerotor pump 600 is installed in a wellbore upstream of a production pump. A portion of the well fluid is used as the cooling fluid. High gas-content well fluid 900 flows into the wellbore past the monitoring sub 902, motor 904 and protector 906 into the gerotor pump 600. As shown in FIG. 9, the well fluid intake into the cavity between the inner rotor 602 and housing 612 is located at the head sub-assembly of the gerotor pump 600. Fluid exit is at the base, which feeds into the suction side of the gerotor pump 600. Well fluid enters from the intake at the head of the gerotor pump 600 and progresses down the gaps 614*a-e* towards the base of the gerotor pump 600. The well fluid comes in contact with the nozzles, which are activated to spray the well fluid into the cavity 616. The remaining well fluid is discharged into the suction section of the gerotor pump 600. The gerotor pump 600 compresses the well fluid and feeds the compressed well fluid to the production pump 908 through the production tubing 910 to be produced to the surface.

A gerotor pump similar or identical to the gerotor pump 600 can be implemented for flowing fluids other than well fluids. In one example, natural gas, which consists mainly of methane and some small amounts of fluid, can be compressed and cooled during compression using the gerotor pump 600. The compressed natural gas can be transported between locations. In another example, nitrogen can be compressed using the gerotor pump 600. During well kick-off for production, nitrogen is injected into the formation to lighten the wellbore fluid column and aid the reservoir to produce naturally. The nitrogen can be compressed using the gerotor pump 600 and injected into the formation to initiate well production.

In some implementations, a gerotor pump such as the gerotor pump 100 can be implemented without the nozzles to cool the compression of the wet gas. As described earlier, the decrease in temperature by implementing the gerotor pump 600 is achieved by injecting cooling fluid into the cavity 616 and by convecting heat away from the cavity 616 using the cooling fluid. Thus, the gerotor pump 100 can be implemented to cool the compression process solely by convecting heat away from the cavity between the inner rotor 102 and the outer rotor 106. In such implementations, the flow rate of the cooling fluid through the gaps 114*a-e* can be higher than the corresponding flow rate of the cooling fluid through the gaps 614*a-e* of the gerotor pump 600.

Particular implementations of the subject matter have been described. Other implementations are within the scope of the following claims.

What is claimed is:

1. A fluid compression and pumping system comprising:

an inner rotor comprising an outer surface defining a plurality of teeth, the inner rotor configured to rotate about a first longitudinal gerotor pump axis;

a hollow outer rotor comprising an inner surface configured to engage with the plurality of teeth and to rotate about a second longitudinal gerotor pump axis;

a pump housing within which the inner rotor and the outer rotor are disposed, wherein an outer surface of the outer rotor defines a plurality of gaps between the pump housing and the outer rotor; and a plurality of nozzles positioned in the hollow outer rotor, each nozzle having an inlet end in a gap of the plurality of gaps between the pump housing and the outer rotor and an outlet end in a region between the inner surface of the outer rotor and the outer surface of the inner rotor, each nozzle configured to spray cooling fluid from the plurality of gaps into the region between the inner surface of the outer rotor and the outer surface of the inner rotor.

2. The system of claim 1, wherein each nozzle is configured to atomize the cooling fluid flowed from the plurality of gaps into the region between the inner surface of the outer rotor and the outer surface of the inner rotor.

3. The system of claim 1, wherein the region between the inner surface of the outer rotor and the outer surface of the inner rotor is configured to flow a fluid therethrough, and wherein the inner rotor and the outer rotor are configured to rotate relative to each other about the first longitudinal gerotor pump axis and the second longitudinal gerotor pump axis, respectively, to compress the fluid, and wherein each nozzle is configured to spray the cooling fluid from the plurality of gaps into the region to reduce a temperature increase resulting from compressing the fluid in the region.

4. The system of claim 3, wherein a direction of flow of the cooling fluid in the plurality of gaps is opposite a direction of flow of the fluid through the region.

5. The system of claim 1, wherein the pump housing comprises:

an inlet to the plurality of gaps, wherein the cooling fluid is flowed into the plurality of gaps through the inlet; and an outlet to the plurality of gaps, wherein the cooling fluid is flowed out of the plurality of gaps through the outlet.

6. The system of claim 1, wherein a first nozzle of the plurality of nozzles is configured to be passively activated to spray the cooling fluid into the region.

7. The system of claim 6, wherein the first nozzle comprises a check valve configured to allow cooling fluid to pass from the plurality of gaps into the region in response to a threshold differential pressure between the plurality of gaps and the region.

8. The system of claim 1, wherein a second nozzle of the plurality of nozzles is configured to be actively activated to spray the cooling fluid into the region using at least one of an electric actuator, a hydraulic actuator or a pneumatic actuator.

9. The system of claim 1, wherein the outer surface of the outer rotor and the inner surface of the outer rotor define a plurality of teeth, each tooth comprising two end portions curving away from a center of the outer rotor, and a central portion that connects the two end portions of each tooth and that curves towards the center of the outer rotor, and wherein each nozzle is positioned in the central portion of each tooth.

10. The system of claim 1, wherein a thickness of a wall between the outer surface of the outer rotor and the inner surface of the outer rotor along a circumference of the outer rotor is equal.

11. A method for pumping and compressing a fluid, the method comprising:

flowing a fluid through a region between an inner surface of an outer rotor and an outer surface of an inner rotor positioned in the outer rotor, wherein the inner rotor comprises an outer surface defining a plurality of teeth, the inner rotor configured to rotate about a first longitudinal gerotor pump axis, wherein the inner surface of the outer rotor is configured to engage with the plurality of teeth and wherein the outer rotor is configured to rotate about a second longitudinal gerotor pump axis, wherein the inner rotor and the outer rotor are positioned within a pump housing, wherein an outer surface of the outer rotor defines a plurality of gaps between the pump housing and the outer rotor, wherein the fluid in the region is compressed in response to the inner rotor and the outer rotor rotating relative to each other about the first longitudinal gerotor pump axis and the second longitudinal gerotor pump axis, respectively; and spraying, by a plurality of nozzles, a cooling fluid from the plurality of gaps to the region in which the fluid is being compressed through a wall between the outer surface of the outer rotor and the inner surface of the outer rotor, wherein the cooling fluid reduces a temperature increase resulting from compressing the fluid in the region.

12. The method of claim 11, further comprising positioning the plurality of nozzles positioned in the hollow outer rotor, each nozzle having an inlet end in a gap of the plurality of gaps between the pump housing and the outer rotor and an outlet end in a region between the inner surface of the outer rotor and the outer surface of the inner rotor, and wherein flowing the cooling fluid from the plurality of gaps to the region in which the fluid is being compressed comprises operating each nozzle to spray cooling fluid from the plurality of gaps into the region.

13. The method of claim 12, wherein the outer surface of the outer rotor and the inner surface of the outer rotor define a plurality of teeth, each tooth comprising two end portions curving away from a center of the outer rotor, and a central portion that connects the two end portions of each tooth and that curves towards the center of the outer rotor, and wherein positioning the plurality of nozzles in the hollow outer rotor comprises positioning each nozzle in the central portion of each tooth.

14. The method of claim 13, further comprising flowing the cooling fluid through the plurality of gaps in a direction that is opposite a direction in which the fluid is flowed through the region.

15. The method of claim 11, further comprising flowing the cooling fluid through the plurality of gaps from a cooling fluid inlet attached to the pump housing to a cooling fluid outlet attached to the pump housing.

16. The method of claim 11, wherein the cooling fluid comprises a portion of the fluid flowed through the region, and wherein the method further comprises:

before flowing the fluid through the region, obtaining the portion of the fluid through a cooling fluid circulation system; and flowing the portion of the fluid through the plurality of gaps.

17. A downhole fluid compression and pumping system comprising:

a gerotor pump disposed inside a wellbore below a surface, the gerotor pump comprising:

an inner rotor comprising an outer surface defining a plurality of teeth, the inner rotor configured to rotate about a first longitudinal gerotor pump axis;

a hollow outer rotor comprising an inner surface configured to engage with the plurality of teeth and to rotate about a second longitudinal gerotor pump axis;

a pump housing within which the inner rotor and the outer rotor are disposed, wherein an outer surface of the outer rotor defines a plurality of gaps between the pump housing and the outer rotor, wherein the gerotor pump is configured to compress a production fluid produced through the wellbore in a region between the inner surface of the outer rotor and the outer surface of the inner rotor by rotating the outer rotor and the inner rotor relative to each other about the first longitudinal gerotor pump axis and the second longitudinal gerotor pump axis, respectively; and a plurality of nozzles positioned in the hollow outer rotor, each nozzle having an inlet end in a gap of the plurality of gaps between the pump housing and the outer rotor and an outlet end in the region between the inner surface of the outer rotor and the outer surface of the inner rotor, each nozzle configured to spray cooling fluid from the plurality of gaps into the region between the inner surface of the outer rotor and the outer surface of the inner rotor.

18. The system of claim 17, wherein each nozzle is configured to atomize the cooling fluid flowed from the plurality of gaps into the region between the inner surface of the outer rotor and the outer surface of the inner rotor.

19. The system of claim 17, further comprising a cooling fluid circulation system configured to flow the cooling fluid through the plurality of gaps.

20. The system of claim 19, wherein the cooling fluid circulation system is configured to flow the cooling fluid through the plurality of gaps in a direction that is opposite a direction of flow of the production fluid through the region.

21. The system of claim 19, wherein the cooling fluid comprises a portion of the production fluid, and wherein the cooling fluid circulation system is configured to siphon a portion of the production fluid before the production fluid flows into the region and to flow the portion of the production fluid through the plurality of gaps.

* * * * *